US008985079B2

(12) United States Patent
Coe, Jr.

(10) Patent No.: US 8,985,079 B2
(45) Date of Patent: Mar. 24, 2015

(54) METHOD AND SYSTEM FOR CONTROLLING A PNEUMATIC STARTER

(75) Inventor: James William Coe, Jr., Rocky Gap, VA (US)

(73) Assignee: Caterpillar Inc., Peoria, IL (US)

( * ) Notice: Subject to any disclaimer, the term of this patent is extended or adjusted under 35 U.S.C. 154(b) by 391 days.

(21) Appl. No.: 13/611,739

(22) Filed: Sep. 12, 2012

(65) Prior Publication Data

US 2014/0069504 A1 Mar. 13, 2014

(51) Int. Cl.
*F02N 7/06* (2006.01)

(52) U.S. Cl.
CPC ..... *F02N 7/06* (2013.01); *F15B 2211/455* (2013.01)
USPC ..... 123/179.31; 60/627

(58) Field of Classification Search
CPC ..... F15B 2211/428; F15B 2211/415; F02N 99/002; F02N 7/00; F02N 7/06
See application file for complete search history.

(56) References Cited

U.S. PATENT DOCUMENTS

| | | | | |
|---|---|---|---|---|
| 3,263,413 | A * | 8/1966 | Van Vactor | 123/198 D |
| 3,664,123 | A * | 5/1972 | Zucca et al. | 123/179.31 |
| 3,722,209 | A * | 3/1973 | Kaytor | 123/179.31 |
| 3,744,602 | A * | 7/1973 | Ajwani | 123/179.31 |
| 4,402,254 | A | 9/1983 | Petrimaux et al. | |
| 4,494,499 | A | 1/1985 | Stein | |
| 4,747,270 | A | 5/1988 | Klie et al. | |
| 5,038,813 | A | 8/1991 | Rossow | |
| 5,528,901 | A | 6/1996 | Willis | |
| 6,935,114 | B2 | 8/2005 | Hajek et al. | |
| 6,971,340 | B1 | 12/2005 | Peng et al. | |
| 7,203,593 | B2 | 4/2007 | Lepley et al. | |
| 7,462,970 | B2 | 12/2008 | Hoff et al. | |
| 7,464,681 | B2 | 12/2008 | Rockwell et al. | |
| 8,578,713 | B2 * | 11/2013 | Zaleski et al. | 123/179.31 |
| 2007/0095321 | A1 | 5/2007 | Marchand et al. | |
| 2008/0078592 | A1 | 4/2008 | Akasam et al. | |
| 2008/0264374 | A1 | 10/2008 | Harris | |
| 2009/0000592 | A1 | 1/2009 | Luft et al. | |
| 2009/0139488 | A1 | 6/2009 | Harris et al. | |
| 2010/0052331 | A1 | 3/2010 | Fonseca | |

OTHER PUBLICATIONS

Doering, "PAV.06 Series," Spec Sheet No. 1200966, available at http://www.doering.com/pdf/1200966.pdf, printed on Sep. 11, 2012 (1 page).

Allenair, "Valves—1/8" Poppet," available at http://www.ipso-sourcing.com/Allenair_Catalog_Poppets.pdf, printed on Sep. 11, 2012, pp. 93-96.

* cited by examiner

*Primary Examiner* — Hieu T Vo
*Assistant Examiner* — Arnold Castro
(74) *Attorney, Agent, or Firm* — Finnegan, Henderson, Farabow, Garrett & Dunner, LLP

(57) ABSTRACT

A system for controlling a starter for starting a power source includes an air starter relay valve fluidly connected between an air tank and the starter. The air starter relay valve is configured to control an amount of air supplied to the starter from the air tank. The system also includes a control device connected to the air starter relay valve and configured to control the air starter relay valve. The system further includes a fuel valve interlock fluidly connected to a source of fuel via a fuel line. The fuel valve interlock is configured to open based on a pressure in the fuel line and configured to send a signal to the control device for controlling the air starter relay valve when the fuel valve interlock is opened.

20 Claims, 2 Drawing Sheets

METHOD AND SYSTEM FOR CONTROLLING A PNEUMATIC STARTER

TECHNICAL FIELD

The present disclosure relates generally to a method and system for starting a machine, and more particularly, to a method and system for controlling a pneumatic starter of a machine.

BACKGROUND

Machines such as haul trucks, loaders, dozers, motor graders, and other types of heavy machinery have an engine for powering the machine. The engine may be a diesel engine, a gasoline engine, a natural gas engine, or any other type of engine known in the art. The engine may produce torque to power the machine, and likewise may require torque to start the engine.

The torque required to start the engine may be generated with a starter. For example, U.S. Pat. No. 4,494,499 (the '499 patent) issued to Stein describes a diesel engine provided with a pneumatic starter that is powered with a pulsed delivery of pressurized gaseous fluid for a limited period of time. When powered, the pneumatic starter engages a pinion gear with a ring gear forming an outer peripheral part of a flywheel. The flywheel is fixed in driving relation to a crankshaft of the engine to provide the required torque to start the engine. The pneumatic starter of the '499 patent may provide some help starting the engine, but it may be less than optimal.

The system of the present disclosure is directed toward solving one or more of the problems of the prior art.

SUMMARY

In one aspect, the present disclosure is directed to a system for controlling a starter for starting a power source. The system includes an air starter relay valve fluidly connected between an air tank and the starter. The air starter relay valve is configured to control an amount of air supplied to the starter from the air tank. The system also includes a control device connected to the air starter relay valve and configured to control the air starter relay valve. The system further includes a fuel valve interlock fluidly connected to a source of fuel via a fuel line. The fuel valve interlock is configured to open based on a pressure in the fuel line and configured to send a signal to the control device for controlling the air starter relay valve when the fuel valve interlock is opened.

In another aspect, the present disclosure is directed to a machine including a power source, an air tank, and a starter operatively connected to the power source and configured to receive air from the air tank to start the power source. The machine also includes an air starter relay valve fluidly connected between the air tank and the starter. The air starter relay valve is configured to control the supply of air to the starter from the air tank. The machine also includes a control device connected to the air starter relay valve and configured to control the air starter relay valve. The machine further includes a fuel pump configured to supply fuel to the power source and a fuel valve interlock fluidly connected to the fuel pump via a fuel line. The fuel valve interlock is configured to open based on a pressure in the fuel line, and configured to direct air from the air tank to the control device to control the air starter relay valve when the fuel valve interlock is opened.

In another aspect, the present disclosure is directed to a method for controlling a starter for starting a power source. The method includes directing a flow of air from an air tank to a fuel valve interlock and directing the flow of air from the fuel valve interlock to a control device based on a fuel pressure from a source of pressurized fuel. The method also includes directing a pilot signal from the control device to an air starter relay valve in response to receiving the flow of air from the fuel valve interlock. The method further includes opening the air starter relay valve in response to the pilot signal to supply air from the air tank to the starter via the air starter relay valve.

DETAILED DESCRIPTION

Reference will now be made in detail to exemplary embodiments of the invention, examples of which are illustrated in the accompanying drawings. Wherever possible, the same reference numbers will be used throughout the drawings to refer to the same or like parts.

Figure 1:
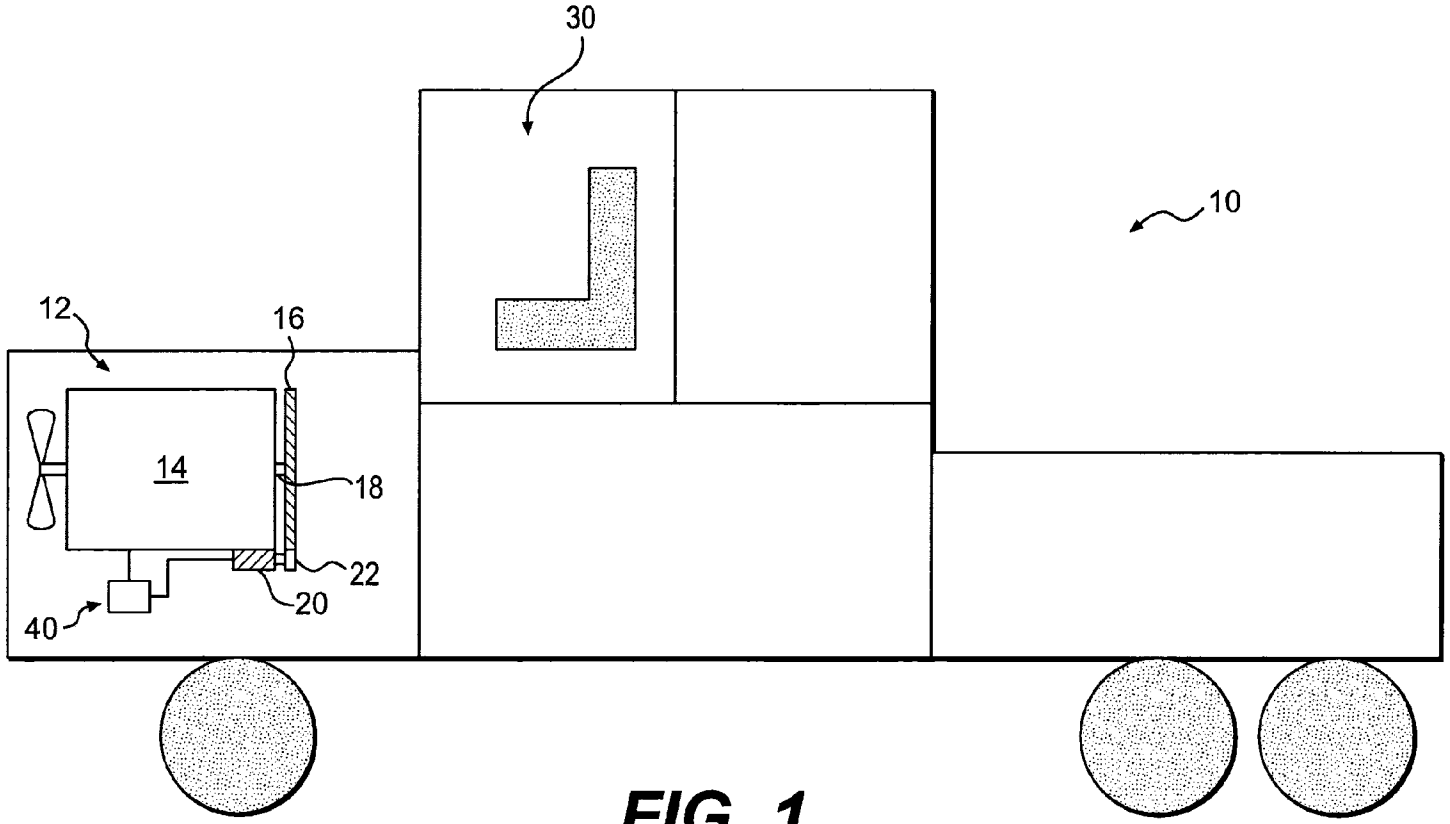
FIG. 1 is a schematic illustration of a machine, according to an embodiment.

FIG. 1 illustrates an embodiment of a machine 10. The machine 10 may have multiple systems and components that cooperate to accomplish a task. The machine 10 may embody a fixed or mobile machine that performs some type of operation associated with an industry such as mining, construction, farming, transportation, or another industry known in the art. For example, the machine 10 may be an earth moving machine such as an excavator, a wheel loader, a front shovel, a bulldozer, a backhoe, a telehandler, a motor grader, a dump truck, or any other earth moving machine.

The machine 10 may have a power system 12, and the power system 12 may include an engine 14 having a flywheel 16. The engine 14 may be, for example, a diesel engine, a gasoline engine, a gaseous fuel-powered engine, or any other type of combustion engine known in the art. The flywheel 16 may be connected to the engine 14. For example, the flywheel 16 may be connected to a crankshaft 18 of the engine 14, or in any other manner known in the art. The flywheel 16 may be any type of device for storing and releasing rotational energy to dampen transient loads placed on or exerted by the engine 14. For example, the flywheel 16 may be a fixed inertia flywheel, a variable inertia flywheel, an electric flywheel, or any other flywheel known in the art. In addition, the flywheel 16 may include multiple rotating masses. It is also contemplated that the flywheel 16 may be absent from the engine 14 and that another device for storing and releasing rotational inertia may be provided.

The power system 12 may also include a starter 20 that may be connected to the engine 14 by engaging a pinion gear 22 with external gear teeth (not shown) of the flywheel 16. The starter 20 may also be connected to engine 14 in other ways. For example, the starter 20 may engage the pinion gear 22 with a gear (not shown) fixed to the crankshaft 18, a ring gear (not shown) on the flywheel 16, or in any other way known in the art. The starter 20 may also directly engage the device for storing and releasing rotational inertia in the system where the flywheel 16 is absent. The starter 20 may be any device for applying torque sufficient to rotate the crankshaft 18 causing one or more pistons (not shown) to reciprocate within one or more cylinders (not shown) of the engine 14, such as a pneumatic starter.

The machine 10 may also include an operator station or cab 30 situated for manual control of the power system 12 and other systems and components. The operator cab 30 may include devices that receive input from an operator indicative of desired machine maneuvering, e.g., starting the engine 14. Specifically, the operator cab 30 may include one or more operator interface devices (e.g., a joystick, a steering wheel, pedals, buttons, etc.) that are located proximate an operator seat. The operator interface devices in the operator cab 30 may include one or more start buttons 32 (FIG. 2) to initiate starting of the engine 14 as will be described below. In the embodiment shown, the machine 10 includes two start buttons, e.g., for a two-handed start by the operator. Alternatively, the machine 10 may include a single start button, more than two start buttons, or other types of input devices to indicate a start.

The machine 10 may include a pneumatic starting control system 40 for controlling the start of the engine 14. For example, the starting control system 40 may be in fluid communication with components of the machine 10 (e.g., the engine 14) and the starter 20 to supply compressed air to the starter 20 to start the engine 14. For example, the compressed air may be supplied to spin a turbine (not shown) that may rotate the pinion gear 22 (FIG. 1) that is engaged with the flywheel 16. The starting control system 40 may control when to initiate the start of the engine 14 (e.g., when to supply the compressed air to the starter 20), and may delay or prevent the start of the engine 14.

Figure 2:
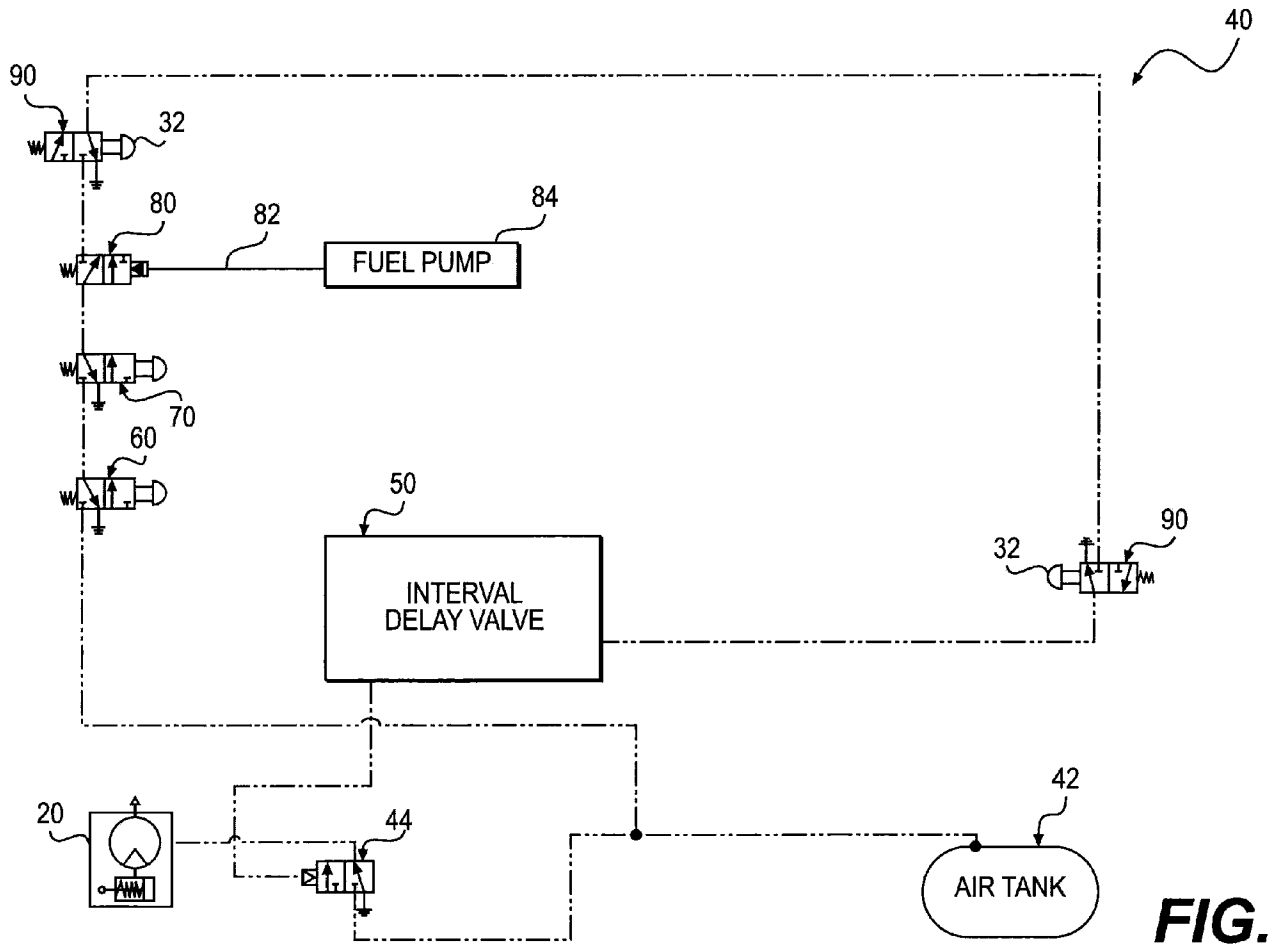
FIG. 2 is a schematic illustration of a starting control system for the machine, according to an embodiment.

As illustrated in FIG. 2, the starting control system 40 may be provided for a pneumatic starting arrangement and may include a pneumatic circuit or system having a plurality of components that cooperate to selectively direct pressurized air or other fluid to the starter 20 to initiate starting of the engine 14. For example, in the embodiment shown in FIG. 2, the starting control system 40 may include an air tank 42 and an air starter relay valve 44.

The air tank 42 may include a source of compressed air, such as, for example, an air reservoir. After starting the engine 14, the engine 14 may drive a compressor (not shown) to recharge the air tank 42. Although only a single tank 42 is shown, it is also contemplated that the starting control system 40 may be in fluid communication with multiple, separate air tanks.

The air starter relay valve 44 may be actuated into open and close positions. In the open position, compressed air is supplied from the air tank 42 to the starter 20. The air starter relay valve 44 may be actuated in response to a command signal or pilot signal (e.g., an air signal) from a control device. In the embodiment of FIG. 2, the control device includes an interval delay valve 50 or other control valve. Alternatively, the pilot signal may be an electrical signal or other fluid signal. The interval delay valve 50 may be configured to send the pilot signal to the air starter relay valve 44 to actuate the air starter relay valve 44 to allow air to be supplied from the air tank 42 to the starter 20 to start the engine 14.

The interval delay valve 50 may control whether to deliver the pilot signal to the air starter relay valve based on one or more signals (e.g., an air signal) received from one or more other valves in the starting control system 40, including a park brake interlock 60, a shifter or transmission interlock 70, a fuel valve interlock 80, and one or more start valves 90 connected to the start button(s) 32 described above. For example, in the embodiment of FIG. 2, the interval delay valve 50 may receive a flow of air or air signal from the air tank 42 when the two start buttons 32, the park brake interlock 60, the transmission interlock 70, and the fuel valve interlock 80 are in their open positions. Although the park brake interlock 60, the transmission interlock 70, and the start valves 90 are shown in FIG. 2 as including push buttons, it is understood that push buttons may be omitted. The park brake interlock 60, the transmission interlock 70, and the start valves 90 may be actuated in response to inputs from other types of components.

The park brake interlock 60 may be actuated into an open position so that the park brake interlock 60 may allow air to be fluidly communicated from the air tank 42 to the transmission interlock 70. The park brake interlock 60 is configured to be actuated when a park brake (not shown) of the machine 10 is set, e.g., when a mechanical detent (not shown) of a linkage of the park brake contacts the park brake interlock 60.

The transmission interlock 70 may also be actuated into an open position so that the transmission interlock 70 may allow air to be fluidly communicated from the air tank 42 (via the park brake interlock 60 when it is also in the open position) to the fuel valve interlock 80. The transmission interlock 70 is configured to be actuated when a transmission (not shown) of the machine 10 is in neutral position, e.g., when a mechanical detent (not shown) of a linkage of the transmission contacts the transmission interlock 70.

The fuel valve interlock 80 may also be actuated into an open position so that the fuel valve interlock 80 may allow air to be fluidly communicated from the air tank 42 (via the park brake interlock 60 and the transmission interlock 70 when they are both also in open positions) to the start valves 90. The fuel valve interlock 80 is configured to be actuated when a fuel pressure is above a threshold. In the embodiment of FIG. 2, the fuel valve interlock 80 is configured to be actuated when a fuel pressure received via a fuel line 82 from a fuel pump 84 or other source of pressurized fuel is above a threshold. The threshold may depend on the application, e.g., the type and size of the engine 14. For example, the fuel pump 84 may be a hand pump that may draw fuel from a fuel tank (not shown) in order to supply pressurized fuel to the engine 14 for starting.

The start valves 90 may also be actuated into open positions so that the start valves 90 may allow air to be fluidly communicated from the air tank 42 (via the park brake interlock 60, the transmission interlock 70, and the fuel valve interlock 80 when they are all in open positions) to the interval delay valve 50. The start valves 90 are configured to be actuated when the operator has pressed the start buttons 32, as described above, to indicate a desire to start the engine 14.

The interval delay valve 50 is configured to send the pilot signal to the air starter relay valve 44 as described above when the flow of air is fluidly communicated from the start valves 90 to the interval delay valve 50. Alternatively, the interval delay valve 50 may delay the delivery of the pilot signal to the air starter relay valve 44 to ensure that a period of time separates consecutive openings of the air starter relay valve 44. For example, the interval delay valve 50 may be configured to determine when the start button(s) 32 were pressed (or when the start valve(s) 90 were opened) previous to the most recent pressing of the start button(s) 32 (or the most recent opening of the start valve(s) 90). If the time difference is less than a certain time period, e.g., approximately one second up to approximately thirty seconds (e.g., approximately six seconds), then the interval delay valve 50 may delay sending the pilot signal to the air starter relay valve 44 until the time period has been completed, or after a different time delay. In addition, the interval delay valve 50 may also be configured to provide other limits to the actuation of the air starter relay valve 44, e.g., by limiting the amount of time that the air starter relay valve 44 is opened.

INDUSTRIAL APPLICABILITY

The disclosed control system and method may have particular applicability with machines having a pneumatic starting arrangement. The disclosed control system and method may control when to start the engine 14 to ensure that adequate fuel pressure and air pressure are provided during the start. Operation of the machine 10 will now be described.

An operator located within the operator cab 30 may command the start of the engine 14 by way of an interface device, e.g., by pressing the start buttons 32 simultaneously with the operator's two hands. Signals generated by the start buttons 32 may be provided to actuate the start valves 90 to move to open positions. If the transmission is in neutral, the park brake is set, and the fuel pressure from the fuel pump 84 is above the threshold, then the park brake interlock 60, the transmission interlock 70, and the fuel valve interlock 80 may also be in open positions. When the park brake interlock 60, the transmission interlock 70, the fuel valve interlock 80, and the start valves 90 are all in open positions, a flow of air may be directed from the air tank 42 to the interval delay valve 50 to serve as an air signal indicating an engine start command. The park brake interlock 60 and the transmission interlock 70 may ensure that the engine 14 does not start until the park brake is set and the transmission is in neutral.

The air tank 42 includes a limited amount of compressed air, which limits the number of possible start attempts for the engine 14. The starting control system 40 prevents the waste of compressed air from the air tank 42 by providing the fuel valve interlock 80 that allows air to be directed to the interval delay valve 50 only if the fuel pressure is above the threshold that corresponds to a fuel pressure that is determined to be sufficient to permit the engine 14 to start. The fuel valve interlock 80 may ensure that there is sufficient fuel pressure to start the engine 14 before allowing air to be supplied from the air tank 42 to the starter 20 to start the engine 14 and therefore may help to prevent wasting air from the air tank 42 on unsuccessful start attempts. Since there may be no limit to the amount of time or number of times that the start buttons 32 may be pressed, the fuel valve interlock 80 may prevent air from being depleted from the air tank 42 before being able to provide the required torque to start the engine 14.

When the interval delay valve 50 receives the flow of air from the air tank 42, the interval delay valve 50 may delay sending the pilot signal to the air starter relay valve 44. For example, the interval delay valve 50 may ensure that a time delay of at least approximately one second to thirty seconds separates each start attempt (e.g., between each time the air starter relay valve 44 is opened). Thus, the interval delay valve 50 may also serve to prevent the operator from depleting air unnecessarily from being released from the air tank 42 to the starter 18 and may ensure that the engine 14 may have enough time to coast to stop after the previous start attempt. As a result, damage to the starter 20, the pinion gear 22, and/or the flywheel 16 may be reduced by helping to avoid engaging the pinion gear 22 with the flywheel 16 while the crankshaft 18 is still rotating.

It will be apparent to those skilled in the art that various modifications and variations can be made to the disclosed method and system. Other embodiments will be apparent to those skilled in the art from consideration of the specification and practice of the disclosed method and system. It is intended that the specification and examples be considered as exemplary only, with a true scope being indicated by the following claims and their equivalents.

What is claimed is:

1. A system for controlling a starter for starting a power source, the system comprising:

an air starter relay valve fluidly connected between an air tank and the starter, the air starter relay valve being configured to control an amount of air supplied to the starter from the air tank;

a control device connected to the air starter relay valve and configured to control the air starter relay valve; and a fuel valve interlock fluidly connected to a source of fuel via a fuel line, the fuel valve interlock being configured to open based on a pressure in the fuel line and configured to send a signal to the control device for controlling the air starter relay valve when the fuel valve interlock is opened.

2. The system of claim 1, wherein the control device is a control valve configured to direct a fluid pilot signal to the air starter relay valve to control actuation of the air starter relay valve.

3. The system of claim 2, wherein the control valve is an interval delay valve configured to control timing of the actuation of the air starter relay valve such that a period of time elapses between consecutive openings of the air starter relay valve.

4. The system of claim 3, wherein the period of time is approximately one to five seconds.

5. The system of claim 2, wherein the fluid pilot signal is an air pilot signal.

6. The system of claim 1, wherein:

the fuel valve interlock is fluidly connected between the air tank and the control device; and the signal to the control device is an air signal that includes air from the air tank.

7. The system of claim 1, wherein the fuel valve interlock is configured to open when the pressure in the fuel line is above a threshold.

8. The system of claim 7, wherein the power source is an engine, and the threshold corresponds to a fuel pressure sufficient to start the engine.

9. The system of claim 1, wherein the source of fuel includes a fuel pump.

10. The system of claim 1, further including a park brake interlock connected to a park brake and fluidly connected between the air tank and the control device, the park brake interlock being configured to open in response to the park brake being engaged.

11. The system of claim 1, further including a transmission interlock connected to a component of a transmission and fluidly connected between the air tank and the control device, the transmission interlock being configured to open in response to the transmission being in neutral.

12. The system of claim 1, further including at least one start valve fluidly connected between the air tank and the control device, the at least one start valve being configured to open in response to an input from an operator.

13. A machine comprising:

a power source;

an air tank;

a starter operatively connected to the power source and configured to receive air from the air tank to start the power source;

an air starter relay valve fluidly connected between the air tank and the starter, the air starter relay valve being configured to control the supply of air to the starter from the air tank;

a control device connected to the air starter relay valve and configured to control the air starter relay valve;

a fuel pump configured to supply fuel to the power source; and a fuel valve interlock fluidly connected to the fuel pump via a fuel line, the fuel valve interlock being configured to open based on a pressure in the fuel line and configured to direct air from the air tank to the control device to control the air starter relay valve when the fuel valve interlock is opened.

14. The machine of claim 13, wherein the power source is an engine, and the control device is an interval delay valve configured to delay actuation of the air starter relay valve by a period of time between consecutive openings of the air starter relay valve.

15. The machine of claim 13, further including:

a park brake interlock connected to a park brake of the machine and fluidly connected between the air tank and the control device, the park brake interlock being configured to open in response to the park brake being engaged; and at least one start valve fluidly connected between the air tank and the control device, the at least one start valve being configured to open in response to an input from an operator.

16. A method for controlling a starter for starting a power source, the method comprising:

directing a flow of air from an air tank to a fuel valve interlock;

directing the flow of air from the fuel valve interlock to a control device based on a fuel pressure from a source of pressurized fuel;

directing a pilot signal from the control device to an air starter relay valve in response to receiving the flow of air from the fuel valve interlock; and opening the air starter relay valve in response to the pilot signal to supply air from the air tank to the starter via the air starter relay valve.

17. The method of claim 16, wherein the flow of air is directed from the fuel valve interlock to the control device in response to an operator input.

18. The method of claim 16, further comprising delaying actuation of the air starter relay valve by a period of time between consecutive openings of the air starter relay valve.

19. The method of claim 18, wherein the period of time is approximately one to thirty seconds.

20. The method of claim 16, further comprising directing the flow of air from the air tank to the control device when a transmission is in neutral and in response to an operator input.

* * * * *